US006143102A

United States Patent [19]

Mendenhall et al.

[11] Patent Number: 6,143,102

[45] Date of Patent: Nov. 7, 2000

[54] BURN RATE-ENHANCED BASIC COPPER NITRATE-CONTAINING GAS GENERANT COMPOSITIONS AND METHODS

[75] Inventors: Ivan V. Mendenhall, Providence; Robert D. Taylor, Hyrum; Michael W. Barnes, Brigham City; David W. Parkinson, N. Ogden, all of Utah

[73] Assignee: Autoliv ASP, Inc., Ogden, Utah

[21] Appl. No.: 09/306,304

[22] Filed: May 6, 1999

[51] Int. Cl.[7] ..... G06B 31/00; G06B 31/02; D03D 23/00

[52] U.S. Cl. ..... 149/45; 149/61; 149/109.6

[58] Field of Search ..... 149/45, 61, 109.6

[56] References Cited

U.S. PATENT DOCUMENTS

| | | | |
|---|---|---|---|
| 5,035,757 | 7/1991 | Poole | 149/46 |
| 5,160,386 | 11/1992 | Lund et al. | 149/88 |
| 5,429,691 | 7/1995 | Hinshaw et al. | 149/45 |
| 5,518,054 | 5/1996 | Mitson et al. | 149/35 |
| 5,542,704 | 8/1996 | Hamilton et al. | 280/741 |
| 5,542,998 | 8/1996 | Bucerius et al. | 149/45 |
| 5,542,999 | 8/1996 | Bucerius et al. | 149/45 |
| 5,608,183 | 3/1997 | Barnes et al. | 149/45 |
| 5,635,668 | 6/1997 | Barnes et al. | 149/45 |
| 5,670,740 | 9/1997 | Barnes et al. | 149/62 |
| 5,756,929 | 5/1998 | Lundstrom et al. | 149/22 |
| 5,773,754 | 6/1998 | Yamato | 149/36 |
| 5,841,065 | 11/1998 | Mendenhall | 149/37 |
| 5,962,808 | 10/1999 | Lundstrom | 149/19.1 |
| 5,989,367 | 11/1999 | Zeuner et al. | 149/47 |

*Primary Examiner*—Charles T. Jordan
*Assistant Examiner*—Aileen J. Baker
*Attorney, Agent, or Firm*—Sally J. Brown

[57] ABSTRACT

Basic copper nitrate-containing gas generant compositions and associated methods are provided for producing or resulting in increased burn rates via the inclusion of an effective amount of one or more metal (e.g., Al, Ti, Zn, Mg and/or Zr) oxide additives.

24 Claims, No Drawings

BURN RATE-ENHANCED BASIC COPPER NITRATE-CONTAINING GAS GENERANT COMPOSITIONS AND METHODS

BACKGROUND OF THE INVENTION

This invention relates generally to gas generant materials, such as those used to inflate automotive inflatable restraint airbag cushions and, more particularly, to burn rate-enhanced gas generant compositions and methods.

Gas generating chemical compositions and formulations are useful in a number of different contexts. One significant use for such compositions is in the operation of automotive inflatable restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated or expanded, in a matter of no more than a few milliseconds, with gas produced or supplied by a device commonly referred to as an "inflator." The airbag cushion is designed to inflate into a location within the vehicle between the occupant and certain parts of the vehicle interior, such as the doors, steering wheel, instrument panel or the like, to prevent or avoid the occupant from forcibly striking such parts of the vehicle interior. As a consequence, nearly instantaneous gas generation is generally desired and required for the effective operation of such inflatable restraint installations.

Various gas generant compositions have heretofore been proposed for use in vehicular occupant inflatable restraint systems. Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as involving the safe and effective handling, supply and disposal of such gas generant materials. Thus, there remains need for safe, effective improved gas generants such as composed of a fuel material and an oxidizer therefor such as upon actuation react to form or produce an inflation gas for inflating vehicular safety restraint devices.

Basic copper nitrate ($Cu(NO_3)_2 \cdot 3Cu(OH)_2$) (sometimes referred to herein by the notation "bCN") has or exhibits various properties or characteristics including, for example, high gas output, density and thermal stability and relatively low cost such as to render desirable the use or gas generant composition inclusion thereof as an oxidizer. The use of such basic copper nitrate or related materials has been the subject of various patents including Barnes et al, U.S. Pat. No. 5,608,183, issued Mar. 4, 1997 and Barnes et al, U.S. Pat. No. 5,635,688, issued Jun. 3, 1997, the disclosures of which are fully incorporated herein by reference.

In practice, it is generally desired or required that the inflators of inflatable restraint systems be able to supply or provide inflation gas in predetermined mass flow rates. The gas mass flow rate resulting upon the combustion of a gas generant composition is typically a function of the surface area of the gas generant undergoing combustion and the burn rate thereof.

A limitation on the greater or more widespread use of basic copper nitrate in such gas generant compositions is that basic copper nitrate-containing gas generant compositions may exhibit or otherwise have associated therewith undesirably low or slow burn rates. In practice, the normal or typical burn rates associated with such gas generant compositions can act to restrict the use of such gas generant compositions to those applications wherein faster burn rates are either not required or desired. For example, such low or slow burn rate compositions may be unsuited for various side impact applications where more immediate generation or supply of inflation gas may be required or desired.

Further, as will be appreciated, various factors, such as including mechanical properties such as strength, may serve to limit or restrict the ability to tailor, change or otherwise alter the shape or geometric form of a gas generant material. Thus, gas generant materials having higher burn rates may permit greater freedom with regard to the shape or form of the gas generant employed.

In addition, for basic purposes such as improved reliability, it is generally desired that at least certain performance characteristics of gas generant materials, e.g., burn rate, be largely independent of ambient conditions such as pressure, for example.

In general, the burn rate for a gas generant composition can be represented by the equation (1), below:

$$Rb=Bp^n \quad (1)$$

where,

Rb=burn rate (linear)

B=constant

P=pressure n=pressure exponent, where the pressure exponent is the slope of the plot of the log of pressure along the x-axis versus the log of the burn rate along the y-axis As will be appreciated, the pressure exponent generally corresponds to the performance sensitivity the respective gas generant material, with lower burn rate pressure exponents corresponding to gas generant materials which desirably exhibit corresponding lesser or reduced pressure sensitivity.

Further, the reduction in either or both the amount and concentration of particulate material that may issue forth from an inflator device upon the actuation thereof has been one focus of continuing improvement efforts with regard to inflatable restraint systems. In particular, there is a need and a demand for gas generant compositions which avoid the need for more extensive or complicated than would otherwise be desired particulate removal means in or associated with an inflator device. As will be appreciated, such extensive or complicated removal means may suffer from one or more disadvantages relating to size, weight and cost.

Unfortunately, various basic copper nitrate-containing gas generant compositions may, upon combustion, produce or result in non-gaseous combustion products which exhibit undesirably poor slagging properties or characteristics. As a result, the use of such basic copper nitrate-containing gas generant compositions may necessitate or require the use of expensive filtration devices or techniques in or in association with corresponding inflator devices.

Thus, there is a need and a demand for gas generant compositions and related methods which while containing basic copper nitrate as a component thereof provide sufficiently high or elevated burn rates. Further, there is a need and a demand for such gas generant compositions and related methods wherein non-gaseous combustion products are of a form which permits the ready removal thereof without necessitating costly or complicated removal devices or techniques.

SUMMARY OF THE INVENTION

A general object of the invention is to provide improved gas generant materials and related methods.

A more specific objective of the invention is to overcome one or more of the problems described above.

The general object of the invention can be attained, at least in part, through a gas generant composition which includes:

a fuel component, a basic copper nitrate oxidizer component therefor, and a metal oxide burn rate enhancing additive component comprising at least one oxide of a metal selected from the group consisting of Al, Ti, Zn, Mg and Zr, in sufficient amount wherein upon ignition of the gas generant composition, the gas generant composition burns at an increased rate as compared to a similar composition without the inclusion of said metal oxide burn rate enhancing additive.

The prior art generally fails to provide basic copper nitrate-containing gas generant compositions and related methods which exhibit a burn rate as high as may be desired such as for particular applications. In addition, the prior art generally fails to provide basic copper nitrate-containing gas generant compositions and related methods which result in non-gaseous combustion products of a form which permits the removal thereof without requiring removal devices or techniques which are more costly or complicated than otherwise generally desired.

The invention further comprehends an ignitable gas generant composition which includes:

about 30 to about 60 weight percent of a gas generating fuel, about 40 to about 65 weight percent of a basic copper nitrate oxidizer, and about 2 to about 10 weight percent of a burn rate enhancing and slag formation additive including about 0.5 to about 5 weight percent of at least one oxide of a metal selected from the group consisting of Al, Ti, Zn, Mg and Zr and about 0.5 to about 5 weight percent of silica.

The invention still further comprehends a method for increasing the burn rate of a gas generant formulation containing a fuel and a basic copper nitrate oxidizer. In accordance with one embodiment of the invention, such method involves including about 0.5 to about 5 weight percent of at least one oxide of a metal selected from the group consisting of Al, Ti, Zn, Mg and Zr in the fuel and basic copper nitrate oxidizer gas generant formulation.

Other objects and advantages will be apparent to those skilled in the art from the following detailed description taken in conjunction with the appended claims.

DETAILED DESCRIPTION OF THE INVENTION

The present invention provides gas generant materials such as may be used in the inflation of inflatable devices such as vehicle occupant restraint airbag cushions. Gas generant materials in accordance with the invention typically include a gas generating fuel component, a basic copper nitrate oxidizer component, a metal oxide burn rate enhancing additive component and, if desired, silica slag formation additive.

As will be appreciated, a variety of materials can, as may be desired, be used as a fuel component in the subject gas generant compositions. For reasons such as identified above, fuel materials for use in the practice of at least certain preferred embodiments of the invention are non-azide in nature. Groups or categories of fuels useful in the practice of the invention include various nitrogen-containing organic fuel materials and tetrazole complexes of at least one transition metal. Specific examples of nitrogen-containing organic fuel materials useful in the practice of the invention include guanidine nitrate, aminoguanidine nitrate, triaminoguanidine nitrate, nitroguanidine, dicyandiamide, triazalone, nitrotriazalone, tetrazoles and mixtures thereof. Fuels complexed by transition metals such as copper, cobalt, and possibly zinc, for example, can be used. Also, the gas generating fuel component of particular gas generant compositions may, if desired, be comprised of individual such fuel materials or combinations thereof. In accordance with certain preferred embodiments of the invention, about 30 to about 60 weight percent of the gas generant composition constitutes a gas generating fuel component.

The fuel component of the subject gas generating material, in accordance with certain particularly preferred embodiments of the invention, includes the fuel material guanidine nitrate either alone or in combination with one or more supplemental fuel materials. In practice, guanidine nitrate is a particularly preferred fuel material due to one or more various factors including: having a relatively low commercial cost and generally avoiding undesired complexing with copper or other transition metals which may also be present; as well as itself being relatively highly oxygenated and thus the inclusion thereof may serve to minimize or reduce the amount of externally provided oxidant required for combustion.

Particularly preferred supplemental fuel materials for use in conjunction with the use of guanidine nitrate include copper complex materials such as composed of a cupric nitrate ligand of the formula: $Cu(L)_2(NO_3)_2$; where L is a ligand selected from the group consisting of ethylenediamine, biuret, ethanol amine and mixtures thereof, as disclosed in Barnes et al., U.S. Pat. No. 5,635,668, issued Jun. 3, 1997, the disclosure of which patent is hereby incorporated by reference herein in its entirety and made a part hereof. An example of a particularly useful such supplemental fuel material is where L is ethylenediamine.

Gas generant compositions containing both guanidine nitrate and such copper complex materials have been found to desirably provide significantly increased burn rates as compare to similar compositions but which do not contain such copper complex materials. In practice, it is generally desirable that, when included, such supplemental fuel material constitute no more than about 40 weight percent and preferably no more than about 30 weight percent of the gas generant composition.

In accordance with certain preferred embodiments of the invention, about 40 to about 65 weight percent of the subject gas generant composition constitutes basic copper nitrate oxidizer, with such oxidizer component being effective to oxidize combustion reaction with the associated fuel component.

As detailed below, the gas generant compositions of the invention include a metal oxide burn rate enhancing additive component. In accordance with the invention and as detailed below, such a metal oxide burn rate enhancing additive component desirably includes at least one oxide of a metal such as Al, Ti, Zn, Mg and Zr. Such additive component is desirably present in the gas generant composition in sufficient amount such that upon ignition of the gas generant composition, the gas generant composition bums at an increased rate as compared to a similar composition without the inclusion of the metal oxide burn rate enhancing additive. Typically, such a metal oxide burn rate enhancing additive component is present in the gas generant compositions of the invention in a relative amount of about 0.5 to about 5 composition weight percent. In practice, such oxides of the metals Al, Zn and Mg may be particularly preferred as such additive materials may beneficially provide the most advantageous combination of effect, e.g., increased burn rate, relative to component cost.

Also, as identified above, the subject gas generant materials may, if desired, additionally contain a silica slag formation additive in sufficient amount wherein upon ignition of the gas generant composition, the gas generant composition forms a more cohesive intact mass of solid combustion products as compared to a similar composition without the inclusion of such silica slag formation additive. In practice, the inclusion of silica in a relative amount of about 0.5 to about 5 composition weight percent is generally effective to achieve desired improved slag formation without significantly detrimentally impacting performance.

In the practice of the invention, it is believed that the gas generant composition incorporation of about 2 to about 10 weight percent of a burn rate enhancing and slag formation additive including about 0.5 to about 5 weight percent of at least one oxide of a metal selected from the group consisting of Al, Ti, Zn, Mg and Zr and about 0.5 to about 5 weight percent of silica can advantageously provide a desirable combination of increased burn rate and increased proportion of solid combustion products relative to liquid combustion products as compared to a similar composition without such additive inclusion.

As will be appreciated by those skilled in the art, gas generant compositions in accordance with the invention can be formed or produced employing various appropriate and proper methods or techniques such as are known in the art.

For example, the subject gas generant compositions can be formed by a process wherein the selected component materials are mixed with water to form a slurry. The slurry can then be spray dried to form a powder or granular material which can then be subjected to usual or typical press processing such as to form wafers, tablets or the like as may be desired.

It is also to be appreciated that if desired and as may be preferred for at least certain gas generant compositions in accordance with the invention, one or more of the gas generant component materials can or may be formed in situ during the preparation of a subject gas generant composition. For example, copper ethylenediamine dinitrate can be formed in situ such as by mixing copper nitrate with water and then adding ethylenediamine thereto.

As will be understood, such in situ component formation may desirably serve as a means to reduce component material costs. However, such in situ component formation may undesirably complicate gas generant composition processing and manufacturing costs.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Trial Set 1—Comparative Examples (CE) 1–6 and Examples (EX)1–9

In these trials, the compositions of the content respectively identified in TABLE 1, below, were prepared using a laboratory preparation procedure wherein:

1. the respective component materials were mixed with water to form a slurry mixture,
2. the slurry mixture was vacuum oven dried and then granulated and sieved to desired size, and
3. pressed to form respective gas generant composition slugs for use in the determination of the burn rate thereof.

Each of the so prepared compositions was tested and evaluated to determine the linear burn rate (Rb) as measured in terms of inches per second at 1000 psi and percent slag recovery therefor. The percent slag recovery refers to the theoretical amount of solids determined by subtracting the weight of the gas produced from the total weight of gas generant reacted. These results are also provided in TABLE 1, below.

TABLE 1

| TRIAL | bCN (%) | $GuNO_3$ (%) | CuEDDN (%) | $Al_2O_3$ (%) | $SiO_2$ (%) | Rb | % slag rec. |
|---|---|---|---|---|---|---|---|
| CE1 | 54.74 | 20.00 | 25.26 | — | — | 0.911 | no solid |
| CE2 | 54.08 | 20.00 | 24.92 | — | 1.00 | 0.676 | 95.3 |
| CE3 | 53.45 | 20.00 | 24.55 | — | 2.00 | 0.688 | 99.5 |
| CE4 | 52.80 | 20.00 | 24.20 | — | 3.00 | 0.634 | 100 |
| CE5 | 52.15 | 20.00 | 23.85 | — | 4.00 | 0.697 | 99.3 |
| CE6 | 51.50 | 20.00 | 23.50 | — | 5.00 | 0.646 | 100 |
| EX1 | 54.12 | 20.00 | 24.88 | 1.00 | — | 0.975 | 75.7 |
| EX2 | 53.48 | 20.00 | 24.52 | 2.00 | — | 1.071 | 56.5 |
| EX3 | 52.81 | 20.00 | 24.19 | 3.00 | — | 0.986 | 57.3 |
| EX4 | 52.17 | 20.00 | 23.85 | 4.00 | — | 0.957 | 57.1 |
| EX5 | 51.52 | 20.00 | 23.48 | 5.00 | — | 0.899 | 43.9 |
| EX6 | 51.51 | 20.00 | 23.49 | 1.00 | 4.00 | 0.695 | 100 |
| EX7 | 51.51 | 20.00 | 23.49 | 2.00 | 3.00 | 0.765 | 100 |
| EX8 | 51.51 | 20.00 | 23.49 | 3.00 | 2.00 | 0.787 | 100 |
| EX9 | 51.51 | 20.00 | 23.49 | 4.00 | 1.00 | 0.769 | 85 |

Discussion of Results

The results of Examples 1–5, as compared to the results of Comparative Example 1, show the effect of alumina on a basic copper nitrate containing gas generant composition.

As shown, that the inclusion of even 1.00 weight percent alumina (Example 1) was effective to increase the burn rate in the tested compositions. The inclusion of 2.00 weight percent alumina (Example 2) resulted in the respective composition having a still further increased burn rate. The inclusion of 3.00 and 4.00 weight percent alumina (Examples 3 and 4), respectively, were also effective to increase the burn rate as compared to a similar composition free of such alumina. Further, the Example 5 inclusion of 5.00 weight percent alumina though resulting in the tested composition having a similar burn rate to the composition of Comparative Example 1, did result in the recovery of some solid slag. Note that the inclusion of lesser amounts of alumina in Examples 1–4 resulted in even greater solid slag recovery, as compared to Example 5.

Note that for CE1, the notation of "no solid" for the percent slag recovered refers to a situation wherein the combustion products were in a liquid, as opposed to, a solid form.

As shown by the results for Comparative Examples 2–6, the inclusion of silica in the tested relative amounts of 1.00–5.00 weight percent, while effective to improve the solid slag recovery of the respective basic copper nitrate oxidized compositions upon reaction, generally resulted in the respective compositions displaying significantly reduced burn rates as compared to a similar composition without such silica inclusion (Comparative Example 1). In particular, such burn rate depression was observed with the inclusion of as little as 1.00 weight percent silica. Further, such burn rate depression did not appear to significantly vary with increased silica content.

Thus, although refractive oxides such as silica and alumina have been used in certain gas generant formulations for purposes of slag improvement, it is wholly unexpected that alumina would be effective for the purpose of increasing the burn rate of the subject basic copper nitrate gas generant formulations especially in view of the burn rate depression observed with the inclusion of as little as 1.00 weight percent of the refractive oxide, silica.

Examples 6–9 show the effect of the inclusion of varying amounts of both alumina and silica on a basic copper nitrate containing gas generant composition. These results show that the inclusion of 2.00 to 4.00 weight percent alumina (Examples 7–9) resulted in compositions having increased linear burn rates as compared to similar compositions without alumina (Comparative Examples 2–4). Further, the Example 6–8 inclusion of alumina and silica resulted in compositions wherein 100 percent of the theoretical slag was recovered intact.

Trial Set 2—Comparative Examples (CE) 7–9 and Examples (EX)10 and 11

In these trials, the compositions of the content respectively identified in TABLE 2, below, were prepared in the manner described above for Trial Set 1 and then tested and evaluated to determine the linear burn rate (Rb) as measured in terms of inches per second at 1000 psi and percent slag recovery therefor. These results are also provided in TABLE 2, below. Note, in contrast to the compositions identified above in TABLE 1, these compositions did not contain a copper complex such as CuEDDN. Also note, that these compositions were not optimized with respect to the amount or proportion of the various components.

TABLE 2

| TRIAL | bCN (%) | $GuNO_3$ (%) | $Al_2O_3$ (%) | $SiO_2$ (%) | Rb | slag quality |
|---|---|---|---|---|---|---|
| CE7 | 47.87 | 52.13 | — | — | 0.28 | Liquid, amorphous |
| CE8 | 40.80 | 54.20 | — | 5.0 | 0.27 | Solid clinker |
| CE9 | 41.86 | 55.64 | — | 2.5 | 0.29 | Solid clinker |
| EX10 | 41.86 | 55.64 | 2.5 | — | 0.55 | Solid clinker but soft |
| EX11 | 40.83 | 54.25 | 2.5 | 2.5 | 0.35 | Solid clinker |

Discussion of Results

In comparing the results of Comparative Examples 8 and 9 with Comparative Example 7, is does not appear that the inclusion of silica, in the tested amounts had a significant impact on the linear burn rate of the compositions. However, the Example 10 and Example 11 inclusion of alumina resulted in the respective compositions having an increased linear burn rate (Rb) as compared to similar compositions free of alumina (Comparative Examples 7 and 9).

Also note that though the total amount of metal oxide additives (alumina and silica) was the same in Comparative Example 8 as in Example 11, the Example 11 composition containing 2.5 weight percent alumina resulted in the respective composition having a significantly increased linear burn.

In view of the above, the inclusion of a metal oxide burn rate enhancing additive component desirably results in the gas generant composition burning at an increased rate as compared to a similar composition without the inclusion of the metal oxide burn rate enhancing additive, even in those compositions which do not contain copper complex materials.

Trial Set 3—Comparative Example (CE) 10 and Examples (EX)12–16

In these trials, the compositions of the content respectively identified in TABLE 3, below, were prepared in the manner described above for Trial Set 1 and then tested and evaluated to determine: the linear burn rate (Rb) as measured in terms of inches per second at 1000 psi, the pressure exponent (i.e., the slope of the plot of the log of pressure along the x-axis versus the log of the burn rate along the y-axis) and the burn rate constant (B). The results are provided in TABLE 3, below, along with the results obtained for Comparative Example 1, provided in TABLE 1, above.

TABLE 3

| TRIAL | bCN (%) | $GuNO_3$ (%) | CuEDDN (%) | Oxide - (%) | Rb | pressure exponent | B |
|---|---|---|---|---|---|---|---|
| CE1 | 54.74 | 20.00 | 25.26 | — | 0.911 | 0.3076 | 0.1088 |
| CE10 | 51.51 | 20.00 | 23.49 | $SiO_2$ -5.00 | 0.635 | 0.4925 | 0.0211 |
| EX12 | 51.52 | 20.00 | 23.48 | $Al_2O_3$ - 5.00 | 0.892 | 0.4145 | 0.0506 |
| EX13 | 51.51 | 20.00 | 23.49 | $TiO_2$ - 5.00 | 0.782 | 0.4473 | 0.0356 |
| EX14 | 51.51 | 20.00 | 23.49 | ZnO - 5.00 | 0.997 | 0.3694 | 0.0777 |
| EX15 | 51.51 | 20.00 | 23.49 | MgO - 5.00 | 0.952 | 0.3323 | 0.0958 |
| EX16 | 51.51 | 20.00 | 23.49 | $ZrO_2$ - 5.00 | 0.723 | 0.3533 | 0.0630 |

Discussion of Results

As shown in TABLE 3, the compositional inclusion of the metal oxides: $Al_2O_3$, $TiO_2$, ZnO, MgO and $ZrO_2$ each resulted in the respective compositions having an increased linear burn rate as compared to similar compositions which instead included the metal oxide additive, $SiO_2$. Further, while the additive amount of the metal oxides $TiO_2$, ZnO, MgO and $ZrO_2$ were not optimized in such testing, the compositions of Examples 14 and 15 (with ZnO and MgO, respectively) resulted in linear burn rates even greater than the similar compositional inclusion of the metal oxide alumina. Further, although the compositional inclusion of alumina in the relative amount used in Example 12 resulted in a decreased linear burn rate as compared to the base case of Comparative Example 1, from Examples 2–4 (above), the use of alumina in lower relative concentrations was found to increase the linear burn rate. Similar results are believed to be also realizable with oxides such as $TiO_2$ and $ZrO_2$.

In view of the above, it will be appreciated and understood that the invention desirably may, in accordance with at least certain preferred embodiments, provide or permit the greater or more widespread use of basic copper nitrate in gas generant compositions such as via the increased burn rates which may result from the practice thereof. As a result, such compositions may no longer be limited or restricted to those applications wherein faster burn rates are either not required or desired. For example, the compositions of the invention may be better suited for various side impact applications where more immediate generation or supply of inflation gas may be required or desired.

Further, the increased burn rate compositions of the invention can provide greater flexibility with respect to the shape or form of the gas generant useable in such installations.

Still further, the gas generant compositions and related methods of the invention may more readily result in non-gaseous combustion products of a form which permits the ready removal thereof without necessitating costly or complicated removal devices or techniques.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generant composition having an increased burn rate, said composition comprising:

a fuel component, a basic copper nitrate oxidizer component therefor, and a burn rate enhancing amount of a metal oxide additive component selected from the group consisting of $Al_2O_3$, $TiO_2$, ZnO, MgO and $ZrO_2$.

2. The gas generant composition of claim 1 wherein said metal oxide additive comprises ZnO.

3. The gas generant composition of claim 1 wherein said metal oxide additive comprises MgO.

4. The gas generant composition of claim 1 wherein said metal oxide additive comprises $Al_2O_3$.

5. The gas generant composition of claim 1 wherein said metal oxide burn rate enhancing additive component is present in a relative amount of about 0.5 to about 5 composition weight percent.

6. The gas generant composition of claim 1 wherein said fuel component comprises guanidine nitrate.

7. The gas generant composition of claim 6 wherein said fuel component additionally comprises a copper complex material.

8. The gas generant composition of claim 7 wherein said copper complex material comprises a cupric nitrate ligand of the formula: $Cu(L)_2(NO_3)_2$; where L is a ligand selected from the group consisting of ethylenediamine, biuret, ethanol amine and mixtures thereof.

9. The gas generant composition of claim 1 wherein said fuel component is present in a relative amount of about 30 to about 60 composition weight percent.

10. The gas generant composition of claim 1 wherein said basic copper nitrate oxidizer component is present in a relative amount of about 40 to about 65 composition weight percent.

11. The gas generant composition of claim 1 additionally comprising a silica slag formation additive in sufficient amount wherein upon ignition of the gas generant composition, the gas generant composition forms a more cohesive intact mass of solid combustion products as compared to a similar composition without the inclusion of said silica slag formation additive.

12. The gas generant composition of claim 11 wherein said silica slag formation additive is present in a relative amount of about 0.5 to about 5 composition weight percent.

13. A method for making a gas generant formulation having an increased burn rate, the gas generant formulation containing a fuel and a basic copper nitrate oxidizer, said method comprising:

including about 0.5 to about 5 weight percent of at least one metal oxide selected from the group consisting of $Al_2O_3$, $TiO_2$, ZnO, MgO and $ZrO_2$ in the gas generant formulation.

14. The method of claim 13 wherein the metal oxide comprises ZnO.

15. The method of claim 13 wherein the metal oxide comprises MgO.

16. The method of claim 13 wherein the metal oxide comprises $Al_2O_3$.

17. The method of claim 16 wherein $Al_2O_3$ is included in a relative amount of about 2 to about 4 composition weight percent.

18. The method of claim 13 wherein the gas generant formulation also has improved slag formation characteristics, the method also comprising the step of:

including about 0.5 to about 5 composition weight percent of $SiO_2$ in the gas generant formulation.

19. An ignitable gas generant composition having enhanced burn rate and slag formation characteristics, said composition comprising:

about 30 to about 60 weight percent of a gas generating fuel component comprising guanidine nitrate, about 40 to about 65 weight percent of a basic copper nitrate oxidizer, a burn rate enhancing amount of a metal oxide selected from the group consisting of $TiO_2$, ZnO, MgO and $ZrO_2$ and a slag formation enhancing amount of $SiO_2$.

20. The composition of claim 19 wherein:

the burn rate enhancing amount of the metal oxide is in the range of about 0.5 to about 5 weight percent of the composition and the slag formation enhancing amount of $SiO_2$ is in the range of about 0.5 to about 5 weight percent of the composition.

21. The composition of claim 19 wherein the metal oxide is ZnO.

22. The composition of claim 19 wherein the metal oxide is MgO.

23. An ignitable gas generant composition having enhanced burn rate and slag formation characteristics, said composition comprising:

about 30 to about 60 weight percent of a gas generating fuel component comprising guanidine nitrate, about 40 to about 65 weight percent of a basic copper nitrate oxidizer, a burn rate enhancing amount of $Al_2O_3$ and a slag formation enhancing amount of $SiO_2$.

24. The composition of claim 23 wherein:

the burn rate enhancing amount of $Al_2O_3$ is in the range of about 0.5 to about 5 weight percent of the composition and the slag formation enhancing amount of $SiO_2$ is in the range of about 0.5 to about 5 weight percent of the composition.

* * * * *